US009281117B2

(12) United States Patent
Dai et al.

(10) Patent No.: US 9,281,117 B2
(45) Date of Patent: Mar. 8, 2016

(54) MAGNETIC CORE STRUCTURE AND ELECTRIC REACTOR

(71) Applicant: Delta Electronics (Shanghai) CO., LTD, Shanghai (CN)

(72) Inventors: Minghui Dai, Shanghai (CN); Ke Dai, Shanghai (CN); Jinping Zhou, Shanghai (CN); Min Zhou, Shanghai (CN); Teng Liu, Shanghai (CN)

(73) Assignee: Delta Electronics (Shanghai) CO., LTD., Shanghai (CN)

( * ) Notice: Subject to any disclaimer, the term of this patent is extended or adjusted under 35 U.S.C. 154(b) by 0 days.

(21) Appl. No.: 14/526,167

(22) Filed: Oct. 28, 2014

(65) Prior Publication Data

US 2015/0194254 A1 Jul. 9, 2015

(30) Foreign Application Priority Data

Jan. 9, 2014 (CN) ..... 2014 1 0010435

(51) Int. Cl.

| | |
|---|---|
| ***H01F 27/28*** | (2006.01) |
| ***H01F 37/00*** | (2006.01) |
| ***H01F 3/10*** | (2006.01) |
| *H01F 3/08* | (2006.01) |

(52) U.S. Cl.

CPC ..... *H01F 37/00* (2013.01); *H01F 3/10* (2013.01); *H01F 3/08* (2013.01); *H01F 27/2823* (2013.01); *H01F 27/2847* (2013.01); *H01F 2003/106* (2013.01)

(58) Field of Classification Search

CPC ..... H01F 27/00–27/30
USPC ..... 336/212, 220–223, 232–234
See application file for complete search history.

(56) References Cited

U.S. PATENT DOCUMENTS

| | | | | |
|---|---|---|---|---|
| 2,947,961 | A * | 8/1960 | Wahlgren | H01F 27/245 336/212 |
| 4,668,931 | A * | 5/1987 | Boenitz | 336/212 |
| 6,100,783 | A * | 8/2000 | Hopkinson et al. | 336/216 |

(Continued)

FOREIGN PATENT DOCUMENTS

| | | | |
|---|---|---|---|
| CN | 101373657 | A | 2/2009 |
| CN | 202839232 | U | 3/2013 |
| JP | 2013080949 | A | 5/2013 |

OTHER PUBLICATIONS

Office Action issued Jun. 11, 2015 by the Taiwan Office.

*Primary Examiner* — Tuyen Nguyen
(74) *Attorney, Agent, or Firm* — Yunling Ren; Eaton & Van Winkle

(57) ABSTRACT

The present application discloses a magnetic core structure and an electric reactor. The magnetic core structure includes an upper cover plate and a lower cover plate which are arranged oppositely and at least one wrapping post having two ends connected to the upper cover plate and lower cover plate, respectively. A cross-sectional area of the upper cover plate and/or of the lower cover plate is larger than that of the wrapping post. The upper cover plate, the lower cover plate and the wrapping post are made of a magnetic powder core material, an amorphous material, a nanocrystalline material or a silicon steel material. Since the cross-sectional area of the upper cover plate and/or of the lower cover plate is larger than that of the wrapping post, this may bring excellent DC-Bias characteristic to an electric reactor or inductor, and make the electric reactor or inductor have lower magnetic core loss.

9 Claims, 14 Drawing Sheets

(56) References Cited

U.S. PATENT DOCUMENTS 7,872,561 B2 * 1/2011 Matumoto ..... 336/200

8,299,885 B2 * 10/2012 Ikriannikov ..... H01F 17/0006
336/212

* cited by examiner

MAGNETIC CORE STRUCTURE AND ELECTRIC REACTOR

CROSS-REFERENCE TO RELATED APPLICATIONS

This application claims priority under 35 U.S.C. §119 to Chinese Patent Application No. 201410010435.4, filed on Jan. 9, 2014, the entire contents of which are incorporated herein by reference.

TECHNICAL FIELD

The present disclosure relates to a magnetic core structure and an electric reactor.

BACKGROUND

Power magnetic devices for switching power supplies are widely used in electrical and electronic fields, such as Uninterrupted Power Supply (UPS), Active Power Filter (APF), Static Var Generator (SVG), solar inverter, power adapter, or communication power supply, etc.

Switching power supplies have a relatively high frequency, and usually employ magnetic materials such as ferrite, magnetic powder core, amorphous material, nanocrystalline, or silicon steel, etc. In many application situations, electrical and electronic products have an operation requirement for current overload, i.e. requiring an overload current of the electrical and electronic products to be larger than a rated current, sometimes up to many times higher than the rated current. For example, under an operation state when a UPS is connected with an external RCD load, the overload current is two to three times larger than the effective value of the rated current. Under such operation state, magnetic devices such as electric reactors or inductors still need to maintain a certain inductance. Thus, if the inductance of the electric reactors or inductors varies greatly as the overload current changes, the products will encounter malfunctions.

As shown in FIGS. 1A and 1B, a magnetic core structure of a conventional inductor or electric reactor includes: an upper cover plate 1 and a lower cover plate 2 which are arranged oppositely, and two wrapping posts 3 connected between the upper cover plate 1 and the lower cover plate 2. Usually, an air gap 4 is provided between each of the wrapping posts 3 and the cover plate 1 or 2, and the air gap 4 may be formed by fiberglass gasket and so on.

In the magnetic core structure of a conventional inductor or electric reactor, a cross-sectional area of the upper cover plate 1 and a cross-sectional area of the lower cover plate 2 are substantially equal to a cross-sectional area of the wrapping post 3, resulting in a poor Direct Current Bias (DC-Bias) characteristic and insufficiency in maintenance of inductance stability.

The above information disclosed in the background portion is only for the purposes of enhancing understanding of the background of the present disclosure, and thus it may include information which does not constitute prior art known to one of ordinary skill in this art.

SUMMARY

One object of the present disclosure is to overcome the defects in conventional technologies by providing a magnetic core structure which has good inductance stability, is capable of bringing excellent DC-Bias characteristic to an electric reactor or an inductor, and has lower magnetic core loss.

Another object of the present disclosure is to provide an electric reactor having the magnetic core structure of the present disclosure.

Additional aspects and advantages of the present disclosure will partially be set forth in the following description and will partially become apparent from the description, or may be realized by the practice of the present disclosure.

According to one aspect of the present disclosure, there is provided a magnetic core structure, which includes an upper cover plate and a lower cover plate which are arranged oppositely and at least one wrapping post having two ends connected to the upper cover plate and the lower cover plate, respectively. A cross-sectional area of the upper cover plate and/or a cross-sectional area of the lower cover plate is larger than a cross-sectional area of the wrapping post. The upper cover plate, the lower cover plate and the wrapping post are made of a magnetic powder core material, an amorphous material, a nanocrystalline material or a silicon steel material.

According to an embodiment of the present disclosure, a DC-Bias characteristic of the wrapping post is superior to a DC-Bias characteristic of the upper cover plate and/or a DC-Bias characteristic of the lower cover plate.

According to an embodiment of the present disclosure, a loss characteristic of the wrapping post is superior to a loss characteristic of the upper cover plate and/or a loss characteristic of the lower cover plate.

According to an embodiment of the present disclosure, a thickness of the upper cover plate or a thickness of the lower cover plate is not smaller than a thickness of the wrapping post, and a height of the upper cover plate or a height of the lower cover plate is larger than a width of the wrapping post.

According to an embodiment of the present disclosure, a height of the upper cover plate or a height of the lower cover plate is not smaller than a width of the wrapping post, and a thickness of the upper cover plate or a thickness of the lower cover plate is larger than a thickness of the wrapping post.

According to an embodiment of the present disclosure, a ratio of the cross-sectional area of the upper cover plate to the cross-sectional area of the wrapping post or a ratio of the cross-sectional area of the lower cover plate to the cross-sectional area of the wrapping post ranges from 1.1 to 3.

According to an embodiment of the present disclosure, the wrapping post has a cross-sectional shape of a circle, an ellipse or a chamfered rectangle.

According to an embodiment of the present disclosure, the number of the wrapping post is two, three or five.

According to an embodiment of the present disclosure, a material of the upper cover plate or a material of the lower cover plate is FeSi magnetic powder core, FeSiAl magnetic powder core or Fe magnetic powder core, and a material of the wrapping post is FeSi magnetic powder core or FeNi magnetic powder core.

According to an embodiment of the present disclosure, the upper cover plate and/or the lower cover plate has a shape of rectangular parallelepiped.

According to another aspect of the present disclosure, there is provided an electric reactor, which includes a magnetic core structure and at least one winding. The magnetic core structure is a magnetic core structure as recited in the present disclosure, and the at least one winding is provided on at least one wrapping post of the magnetic core structure.

According to an embodiment of the present disclosure, a thickness of the upper cover plate or a thickness of the lower cover plate is not smaller than a thickness of the wrapping post, and a height of the upper cover plate or a height of the lower cover plate is larger than a width of the wrapping post in the magnetic core structure.

According to an embodiment of the present disclosure, the thickness of the upper cover plate or the thickness of the lower cover plate is equal to the thickness of the wrapping post in the magnetic core structure.

According to an embodiment of the present disclosure, the winding is formed by wound metallic foil.

According to an embodiment of the present disclosure, a height of the upper cover plate or a height of the lower cover plate is not smaller than a width of the wrapping post, and a thickness of the upper cover plate or a thickness of the lower cover plate is larger than a thickness of the wrapping post in the magnetic core structure.

According to an embodiment of the present disclosure, the winding is formed by wound metallic wire.

It can be seen from the above technical solutions that advantages and positive effects of the magnetic core structure of the present disclosure reside in: in the magnetic core structure of the present disclosure, since the cross-sectional area of the upper cover plate and/or the cross-sectional area of the lower cover plate is larger than the cross-sectional area of the wrapping post, this may bring excellent DC-Bias characteristic and inductance stability to an electric reactor or an inductor, and may make the electric reactor or the inductor have lower magnetic core loss.

BRIEF DESCRIPTION OF THE DRAWINGS

The above and other features and advantages of the present disclosure will become more apparent from the follow ing description of exemplary embodiments with reference to the drawings, in which.

DETAILED DESCRIPTION

The general inventive conception of the present disclosure is to make a cross-sectional area of an upper cover plate and/or a cross-sectional area of a lower cover plate larger than a cross-sectional area of a wrapping post in a magnetic core structure, so as to improve a DC-Bias characteristic of an electric reactor or an inductor using this magnetic core structure.

Now, exemplary embodiments will be described more comprehensively with reference to the drawings. However, the exemplary embodiments may be carried out in various manners, and shall not be interpreted as being limited to the embodiments set forth herein; instead, providing these embodiments will make the present disclosure more comprehensive and complete, and will fully convey the conception of the exemplary embodiments to one of ordinary skill in this art. Throughout the drawings, similar reference signs indicate the same or similar structures, and their detailed description will be omitted.

The features, structures or characteristics described herein may be combined in one or more embodiments in any suitable manner. In the following description, many specific details are provided to facilitate sufficient understanding of the embodiments of the present disclosure. However, one of ordinary skill in this art will appreciate that the technical solutions in the present disclosure may be practiced without one or more of the specific details, or other methods, elements, materials and so on may be employed. In other conditions, well-known structures, materials or operations are not shown or described in detail to avoid confusion of respective aspects of the present disclosure.

The First Embodiment of the Magnetic Core Structure

Figure 2A:
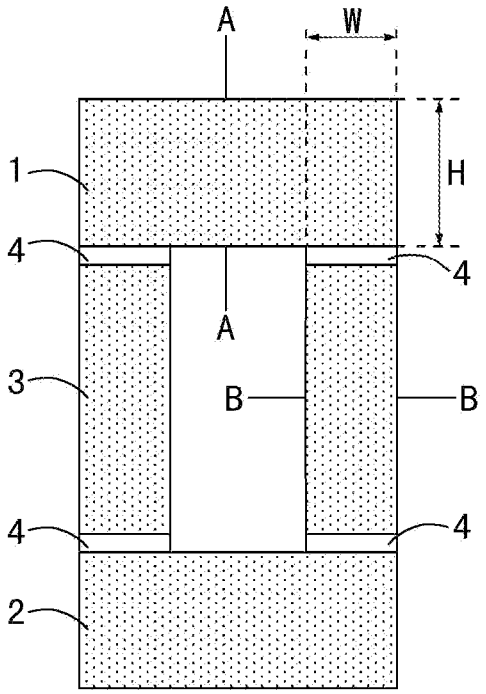
FIG. 2A is a schematic structural diagram of a first embodiment of a magnetic core structure according to the present disclosure.
Figure 2B:
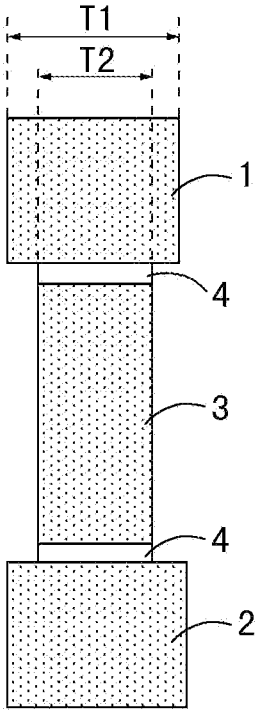
FIG. 2B is a left view of FIG. 2A.

Referring to FIGS. 2A and 2B, the first embodiment of the magnetic core structure in the present disclosure includes: an upper cover plate 1 and a lower cover plate 2 which are arranged oppositely (i.e., arranged to face each other), and two wrapping posts 3 connected between the upper cover plate 1 and the lower cover plate 2.

Air gaps 4 are provided between upper and lower ends of each wrapping post 3 and the cover plate 1 or 2, respectively. Alternatively, the magnetic core structure may have only one wrapping post 3 or a plurality of wrapping posts 3. Shapes of the upper cover plate 1, the lower cover plate 2 and the wrapping posts 3 are all rectangular parallelepiped, but not limited thereto. The upper cover plate 1, the lower cover plate 2 or the wrapping posts 3 may also have other shapes such as cylinder.

An area of a cross section (i.e., the cross section taken along line A-A in FIG. 2A) of the upper cover plate 1 is larger than an area of a cross section (i.e., the cross section taken along line B-B in FIG. 2A) of the wrapping post 3; an area of a cross section of the lower cover plate 2 is larger than the area of the cross section of the wrapping post 3.

In the first embodiment of the magnetic core structure, a height H of the upper cover plate 1 is larger than or equal to a width W of the wrapping post 3, a thickness T1 of the upper cover plate 1 is larger than a thickness T2 of the wrapping post 3, and a thickness T1 of the lower cover plate 2 is larger than the thickness T2 of the wrapping post 3.

Materials of the upper cover plate 1, the lower cover plate 2 and the wrapping posts 3 may be a magnetic powder core material. However, the present disclosure is not limited thereto, the materials of the upper cover plate 1, the lower cover plate 2 and the wrapping post 3 may also be an amorphous material, a nanocrystalline material or a silicon steel material.

The Second Embodiment of the Magnetic Core Structure

Figure 3A:
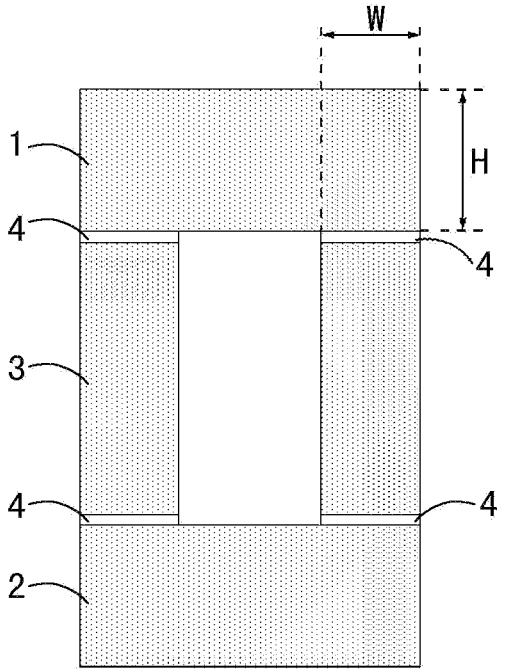
FIG. 3A is a schematic structural diagram of a second embodiment of a magnetic core structure according to the present disclosure.
Figure 3B:
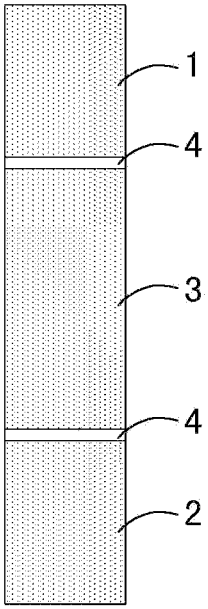
FIG. 3B is a left view of FIG. 3A.

Referring to FIGS. 3A and 3B, the difference between the second embodiment and the first embodiment of the magnetic core structure of the present disclosure only resides in that the thickness of the upper cover plate 1, the thickness of the lower cover plate 2 and the thickness of the wrapping post 3 are equal to each other, so that a front surface and a rear surface of the magnetic core structure in the second embodiment are respectively in one plane.

In order to ensure that the cross-sectional area of the upper cover plate 1 or the cross-sectional area of the lower cover plate 2 is larger than the cross-sectional area of the wrapping post 3, under the situation where the thickness of the upper cover plate 1, the thickness of the lower cover plate 2 and the thickness of the wrapping post 3 are the same, the height H of the upper cover plate 1 is larger than the width W of the wrapping post 3, and the height of the lower cover plate 2 is larger than the width of the wrapping post 3.

In other embodiments, in order to ensure that the cross-sectional area of the upper cover plate 1 or the cross-sectional area of the lower cover plate 2 is larger than the cross-sectional area of the wrapping post 3, it may also be possible to make the thickness of the upper cover plate 1 or the thickness of the lower cover plate 2 larger than or equal to the thickness of the wrapping post 3; or, it may be possible to make the height H of the upper cover plate 1 larger than the width W of the wrapping post 3, and make the height of the lower cover plate 2 larger than the width of the wrapping post 3.

Other structures of the second embodiment of the magnetic core structure are substantially the same as those of the first embodiment, and thus their detailed descriptions are omitted herein.

The Third Embodiment of the Magnetic Core Structure

Figure 4A:
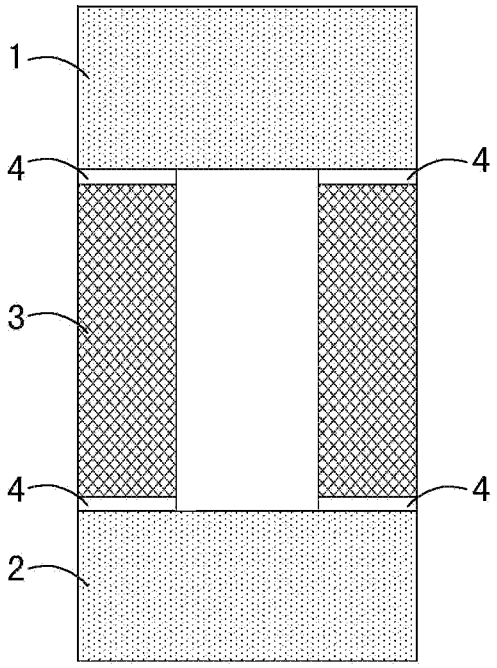
FIG. 4A is a schematic structural diagram of a third embodiment of a magnetic core structure according to the present disclosure.
Figure 4B:
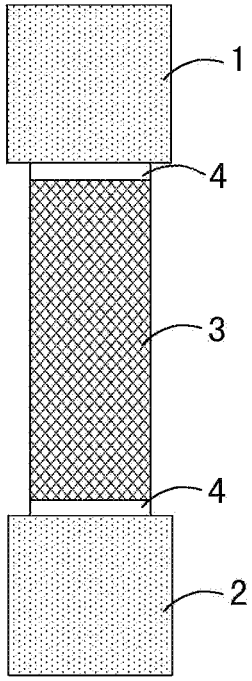
FIG. 4B is a left view of FIG. 4A.

Referring to FIGS. 4A and 4B, the difference between the third embodiment and the first embodiment of the magnetic core structure in the present disclosure only resides in that the material of the wrapping post 3 differs from the materials of the upper cover plate 1 and the lower cover plate 2. The DC-Bias characteristic of the materials of the upper cover plate 1 and the lower cover plate 2 is inferior to the DC-Bias characteristic of the material of the wrapping post 3. For example, the upper cover plate 1 and the lower cover plate 2 employ a FeSiAl magnetic powder core material (Sendust, koolmu), a FeSi magnetic powder core material (FeSi, Megaflux, Xflux), or a Fe magnetic powder core material, and the wrapping post 3 employs a FeSi magnetic powder core material or a FeNi magnetic powder core material (Highflux, KH). Regarding the above magnetic powder core material, it is known in the prior art that the DC-Bias characteristic of the materials successively deteriorates in an order of the FeNi magnetic powder core material, the FeSi magnetic powder core material, the FeSiAl magnetic powder core material, and the Fe magnetic powder core material.

In the third embodiment of the magnetic core structure, materials having poor DC-Bias characteristic may be used to substitute the materials having better DC-Bias characteristic to form the upper cover plate 1 and the lower cover plate 2, and an electric reactor or an inductor using such magnetic core structure may still obtain better DC-Bias performance.

In addition, a loss of the materials used in the upper cover plate 1 and the lower cover plate 2 is higher than a loss of the material used in the wrapping post 3. Since magnetic induction intensity at the upper and lower cover plates is relatively low and magnetic core loss is relatively small, forming the upper and lower cover plates by using materials having a poor magnetic core loss characteristic instead of materials having a better magnetic core loss characteristic may still obtain lower magnetic core loss, and thereby the material cost of the magnetic core structure may be reduced.

Other structures of the third embodiment of the magnetic core structure are substantially the same as those of the first embodiment, and thus their detailed descriptions are omitted herein.

The Fourth Embodiment of the Magnetic Core Structure

Figure 5A:
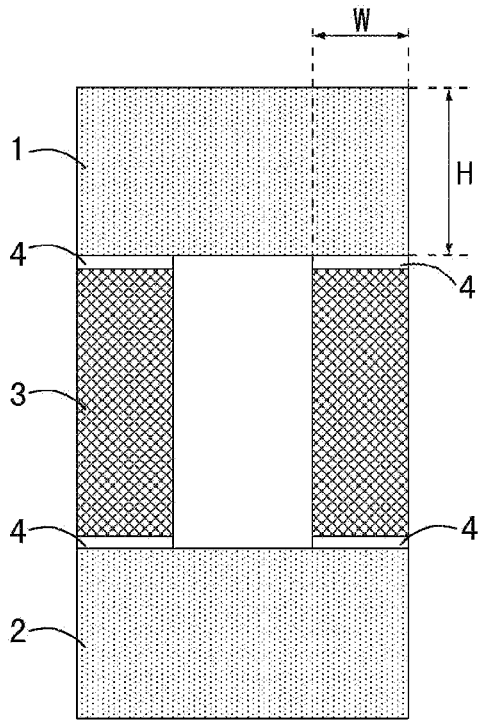
FIG. 5A is a schematic structural diagram of a fourth embodiment of a magnetic core structure according to the present disclosure.
Figure 5B:
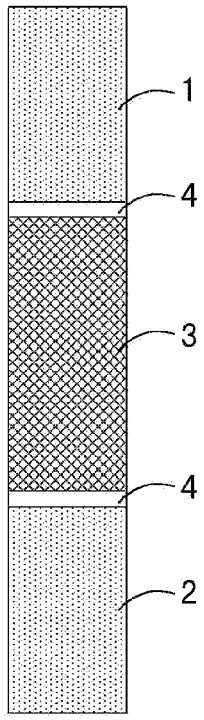
FIG. 5B is a left view of FIG. 5A.

Referring to FIGS. 5A and 5B, the difference between the fourth embodiment and the third embodiment of the magnetic core structure in the present disclosure only resides in that the thickness of the upper cover plate 1, the thickness of the lower cover plate 2 and the thickness of the wrapping post 3 are equal to each other. Thus, a front surface and a rear surface of the fourth embodiment of the magnetic core structure are respectively in one plane. In order to ensure that the cross-sectional area of the upper cover plate 1 or the cross-sectional area of the lower cover plate 2 is larger than cross-sectional area of the wrapping post 3, the height H of the upper cover plate 1 is larger than the width W of the wrapping post 3, and the height of the lower cover plate 2 is larger than the width of the wrapping post 3.

Other structures of the fourth embodiment of the magnetic core structure are substantially the same as those of the third embodiment, and thus their detailed descriptions are omitted herein.

The Fifth Embodiment of the Magnetic Core Structure

Figure 6A:
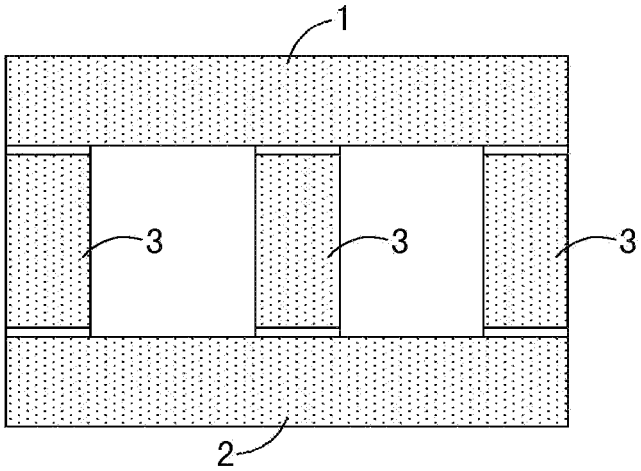
FIG. 6A is a schematic structural diagram of a fifth embodiment of a magnetic core structure according to the present disclosure.
Figure 6B:
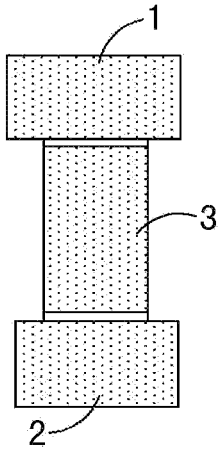
FIG. 6B is a left view of FIG. 6A.

Referring to FIGS. 6A and 6B, the difference between the fifth embodiment and the first embodiment of the magnetic core structure in the present disclosure only resides in that the magnetic core structure in the fifth embodiment has three wrapping posts 3, and thereby a three-phase-three-post magnetic core structure is formed. Thus, the magnetic core structure in the present disclosure is not limited to a single phase magnetic core structure, but also applicable for a three phase magnetic core structure.

Other structures of the fifth embodiment of the magnetic core structure are substantially the same as those of the first embodiment, and thus their detailed descriptions are omitted herein.

The Sixth Embodiment of the Magnetic Core Structure

Figure 7A:
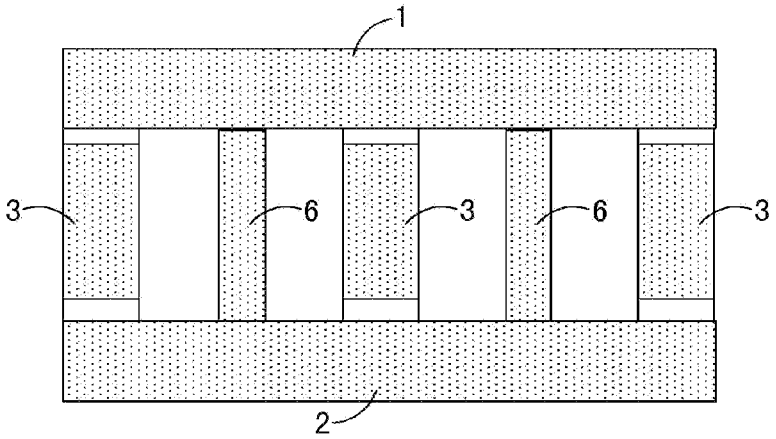
FIG. 7A is a schematic structural diagram of a sixth embodiment of a magnetic core structure according to the present disclosure.
Figure 7B:
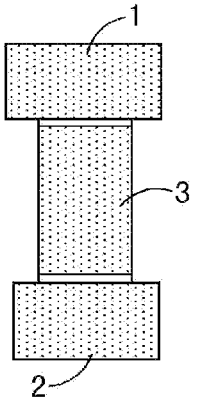
FIG. 7B is a left view of FIG. 7A.

Referring to FIGS. 7A and 7B, on the basis of the fifth embodiment, two posts 6 are further added to the sixth embodiment of the magnetic core structure in the present disclosure, so as to form a three-phase-five-post magnetic core structure. A material of the added two posts 6 may be the same as the material of the upper cover plate and the lower cover plate, and no air gap is particularly disposed between upper and lower ends of the added posts 6 and the upper and lower cover plates 1, 2.

Other structures of the sixth embodiment of the magnetic core structure are substantially the same as those of the first embodiment, and thus their detailed descriptions are omitted herein.

The First Embodiment of the Inductor

Figure 8A:
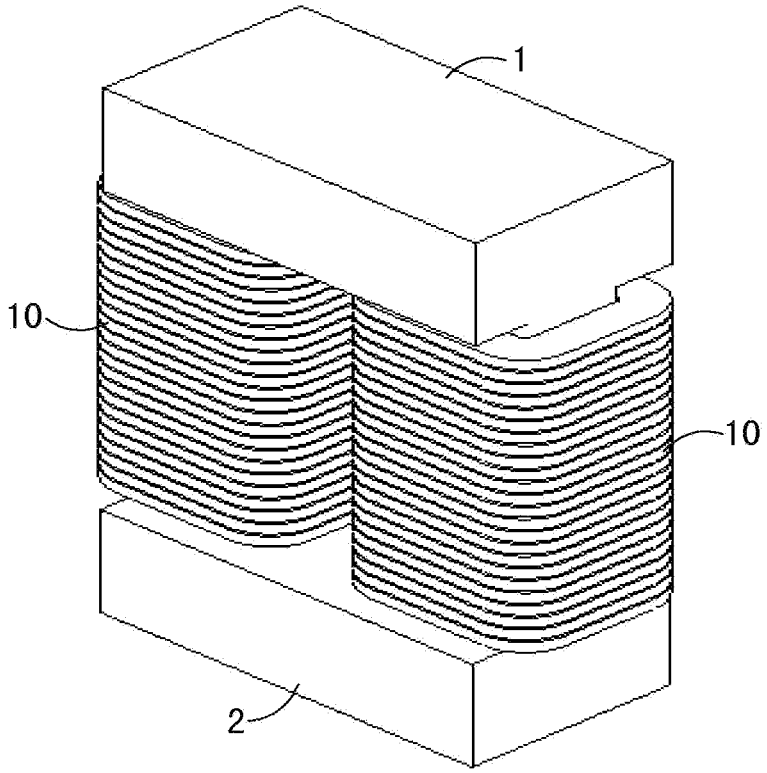
FIG. 8A is a schematic structural diagram of a first embodiment of an electric reactor according to the present disclosure.
Figure 8B:
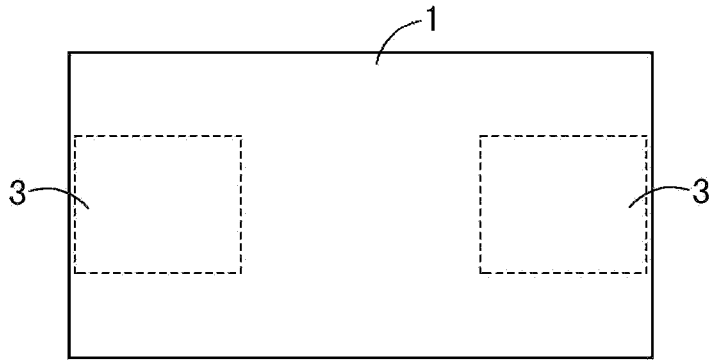
FIG. 8B is a top view of FIG. 8A.

Referring to FIGS. 8A and 8B, the first embodiment of the electric reactor of the present disclosure includes a magnetic core structure and a winding.

The magnetic core structure is similar to the first embodiment of the magnetic core structure in the present disclosure, and includes an upper cover plate 1 and a lower cover plate 2 which are arranged oppositely and two wrapping posts 3 connected between the upper cover plate 1 and the lower cover plate 2. A cross section of the wrapping post 3 is rectangular, and the cross-sectional area of the wrapping post 3 is smaller than the cross-sectional area of the upper cover plate 1 or the cross-sectional area of the lower cover plate 2.

A flat metallic wire may be used for the winding. For example, flat copper wires 10 may be wound around the wrapping posts 3 in a vertical winding manner, and there is a heat dissipation channel between two adjacent layers of flat copper wires 10. The flat metallic wire being wound in a vertical winding manner may facilitate heat dissipation.

It shall be noted that metallic foils wound around the wrapping posts may also be used for the winding.

Figure 9:
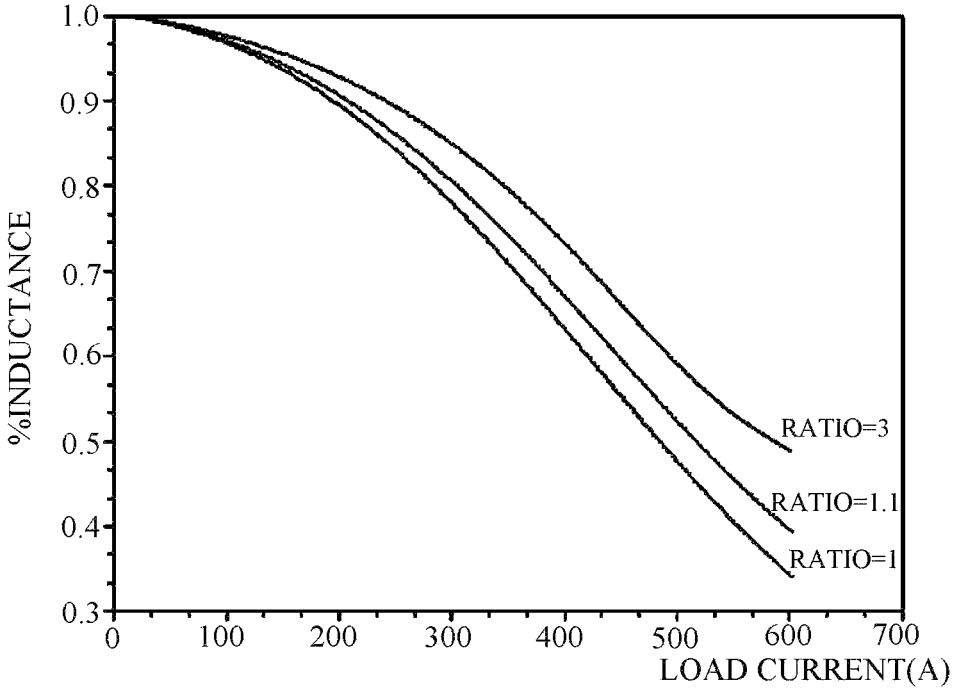
FIG. 9 shows DC-Bias curves under different cross-sectional area ratios in the first embodiment of the electric reactor according to the present disclosure.

In the first embodiment of the magnetic core structure, a ratio of an area of the cross section (perpendicular to the magnetic flux) of the upper cover plate 1 or the lower cover plate 2 to an area of the cross section (perpendicular to the magnetic flux) of the wrapping post 3 is 1.1. However, the ratio is not limited to 1.1, and usually a ratio ranging from 1.1 to 3 is also applicable. Different ratios may correspond to different DC-Bias characteristic curves. As shown in FIG. 9, for an electric reactor having a rated current 190 A and a maximum current 603 A, different DC-Bias characteristic curves may be obtained under different ratios of cross-sectional area of the upper or lower cover plate to the cross-sectional area of the wrapping post. It can be seen from FIG. 9 that as the load current increases, the DC-Bias characteristics in the solution having a cross sectional area ratio of 1.1 and in the solution having a cross sectional area ratio of 3 are far better than the DC-Bias characteristic in the solution having a cross section area ratio of 1 (the vertical coordinate represents percentage of inductance). The DC-Bias characteristic means that when there is magnetic field passing through a material of a magnetic core, an incremental permeability of the material of the magnetic core will gradually decrease as the magnetic field increases. The definition of the incremental permeability is as follows:

$$\mu_\Delta = \frac{1}{\mu_0}\frac{\Delta B}{\Delta H}\bigg|_{H_}$$

where $\mu_\Delta$ represents the incremental permeability, $\mu_o$ represents a vacuum permeability which is a constant, ΔB represents variation amount of a magnetic induction intensity, ΔH represents variation amount of a magnetic field density, and H_ represents a magnetic field density under a certain load.

Figure 10:
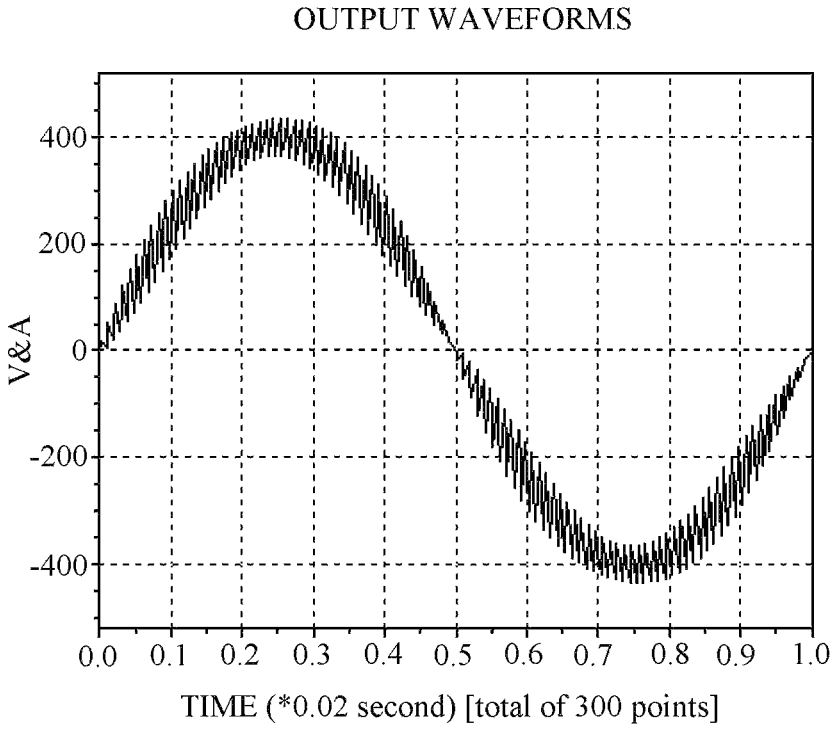
FIG. 10 shows a current pattern obtained by superposition of a low frequency power current and a high frequency ripple, a current waveform of a UPS storage electric reactor.

The physical meaning represented by the incremental permeability is a permeability of an Alternating Current (AC) component when an AC magnetic field is superimposed on a DC (or power frequency) magnetic field. For electrical and electronic products, current waveforms of many inducers are a waveform of a superposition of a low frequency current and/or voltage and an AC ripple, as shown in FIG. 10, and at this time the magnetic field inside the inducer also has such a waveform. The inductance required at this time is inductance for the AC ripple, and this inductance may be measured by the incremental permeability $\mu_\Delta$. Under the same low frequency magnetic field density, the decreased percentage of the incremental permeability (corresponding to the inductance when the electric reactor has a load) as compared with the initial permeability (corresponding to the initial inductance of the electric reactor) indicates a capability of the magnetic core structure for maintaining inductance stability. The more the incremental permeability is decreased, the poorer the capability of the magnetic core structure for maintaining inductance stability is, i.e., the poorer the DC-Bias characteristic is. On the contrary, the less the incremental permeability is decreased, the better the capability of the magnetic core structure for maintaining inductance stability is, i.e., the better the DC-Bias characteristic is.

Figure 1A:
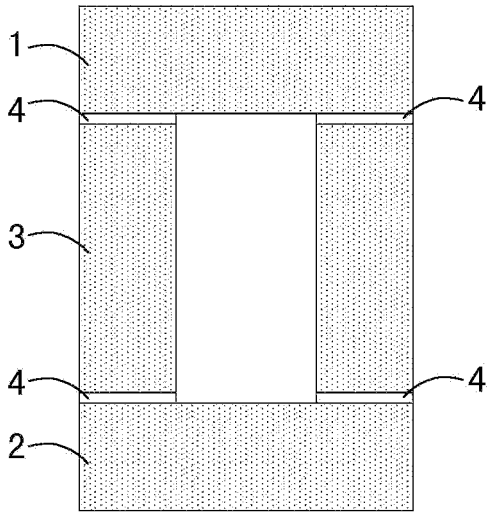
FIG. 1A is a schematic structural diagram of a conventional magnetic core structure.
Figure 1B:
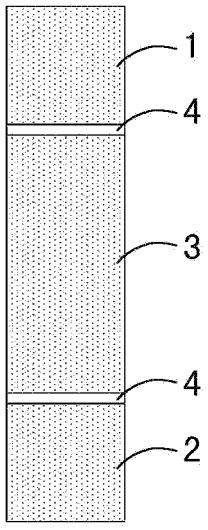
FIG. 1B is a left view of FIG. 1A.

In the first embodiment of the inductor of the present disclosure, the cross-sectional area of the upper cover plate 1 or the cross-sectional area of the lower cover plate 2 is larger than the cross-sectional area of the wrapping post 3, and as compared with the conventional magnetic core structure as shown in FIGS. 1A and 1B in which the cross-sectional area of the cover plate and the cross-sectional area of the wrapping post are the same, a magnetic reluctance R2' of the upper cover plate 1 or the lower cover plate 2 in the first embodiment of the electric reactor of the present disclosure is smaller than a magnetic reluctance R2 of the upper or lower cover plate in the conventional structure. Since air gaps usually exist in magnetic core structures (distributed air gaps or concentrated air gaps), in the first embodiment of the electric reactor of the present disclosure, an air gap magnetic reluctance Rg2 may be increased to share magnetic pressure, the magnetic reluctance of the wrapping post keeps unchanged, and thus, the magnetic reluctance of the whole magnetic core structure keeps unchanged and the initial inductance keeps unchanged. Accordingly, under practical operation condition, a magnetic pressure drop of the upper or lower cover plate in FIG. 2B is smaller than a magnetic pressure drop of the magnetic core structure in FIG. 1B. Thus, the fall-down of the incremental permeability at the upper or lower cover plate decreases, while the magnetic field density inside the wrapping post keeps unchanged, and the fall-down of the incremental permeability at the wrapping post keeps unchanged. Thus, from the viewpoint of the whole electric reactor, the whole fall-down of the inductance becomes smaller, i.e., the DC-Bias performance becomes better. A precondition here is that the initial inductances are consistent so as to facilitate comparison. When the initial inductances are consistent, the AC magnetic flux of the upper or lower cover plate in the two magnetic core structures keep unchanged, and the cross-sectional areas increase, and thereby the AC magnetic induction intensity AB decreases. Thus, according to general Steinmetz equation $P=cm\cdot\Delta B^{*}f^{y}$ (where P represents a magnetic core loss per unit volume, cm, x and y are constants, ΔB represents an AC magnetic induction intensity, and f represents an operation frequency), the magnetic core loss per unit volume will be reduced. As known in the prior art, the Steinmetz equation is a formula for the evaluation of a loss per unit volume of a certain magnetic material, wherein each magnetic material has a set of factors Cm, x and y describing the magnitude of the loss, and a magnetic core loss is proportional to the ΔB*, i.e., for the same material, the magnetic core loss reduces as the ΔB reduces. In addition, since the magnetic pressure drop of the upper or lower cover plate decreases and the magnetic reluctance of the air diffused at the upper or lower cover plate keeps unchanged, the magnetic flux leakage will decrease, and the winding loss caused by the magnetic flux leakage will also decrease.

Thus, in the first embodiment of the inductor, on the basis that the DC-Bias performance of the whole magnetic core is improved, the magnetic core loss of the upper or lower cover plate is reduced, and the magnetic flux leakage at the upper or lower cover plate and the winding loss caused by the magnetic flux leakage are reduced.

The Second Embodiment of the Inductor

Figure 11A:
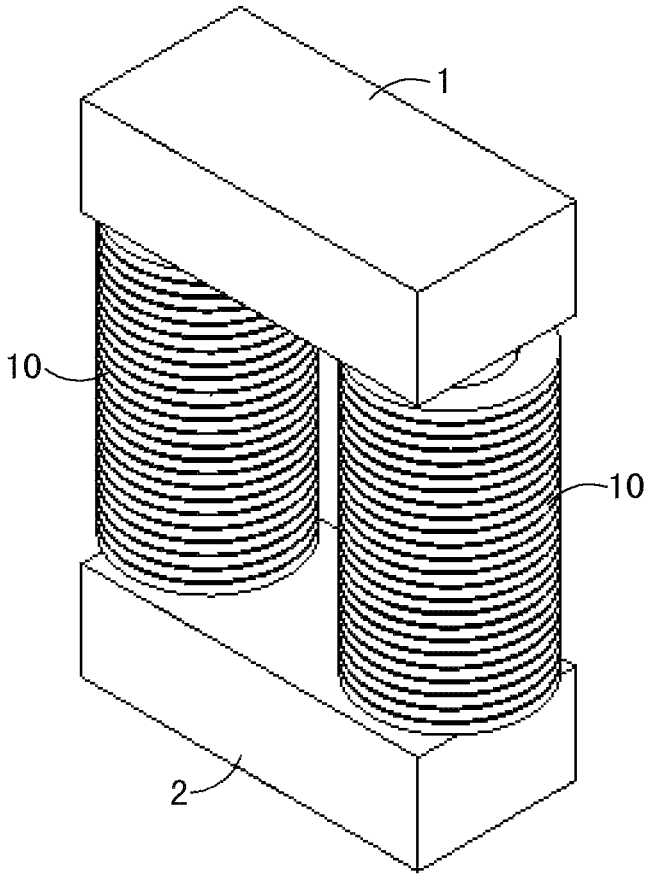
FIG. 11A is a schematic structural diagram of a second embodiment of an electric reactor according to the present disclosure.
Figure 11B:
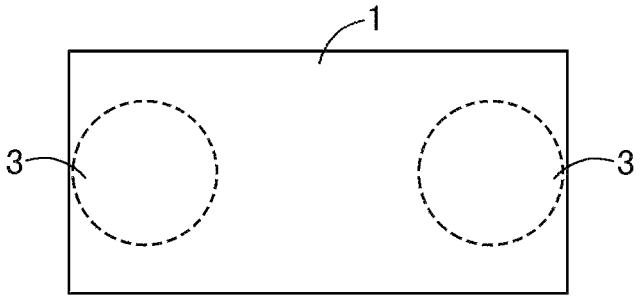
FIG. 11B is a top view of FIG. 11A.

Referring to FIGS. 11A and 11B, the difference between the second embodiment and the first embodiment of the electric reactor in the present disclosure only resides in that the shape of the cross section of the wrapping post 3 is a circle. For the same cross-sectional area of the wrapping post 3, a circle has the shortest perimeter, thus, the length of the winding may be shortened, and thereby the electric resistance may be reduced, resulting in a reduction in the winding loss.

Other structures of the second embodiment of the inductor are substantially the same as those of the first embodiment, and thus their detailed descriptions are omitted herein.

The Third Embodiment of the Inductor

Figure 12A:
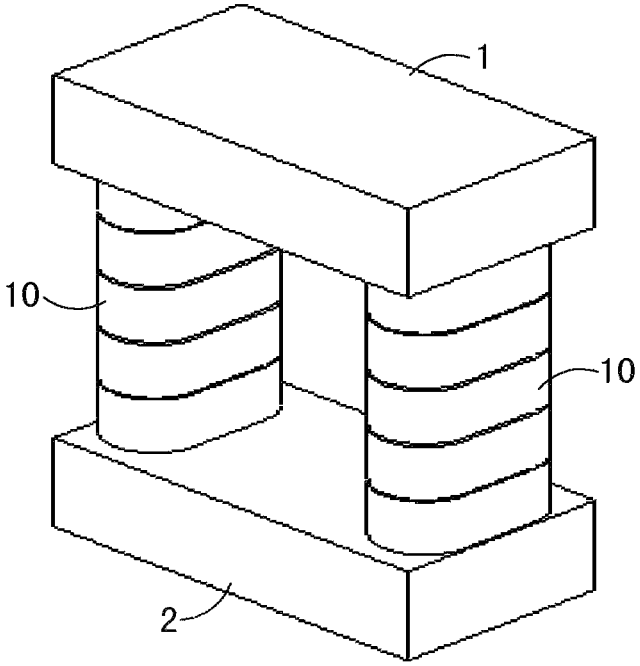
FIG. 12A is a schematic structural diagram of a third embodiment of an electric reactor according to the present disclosure.
Figure 12B:
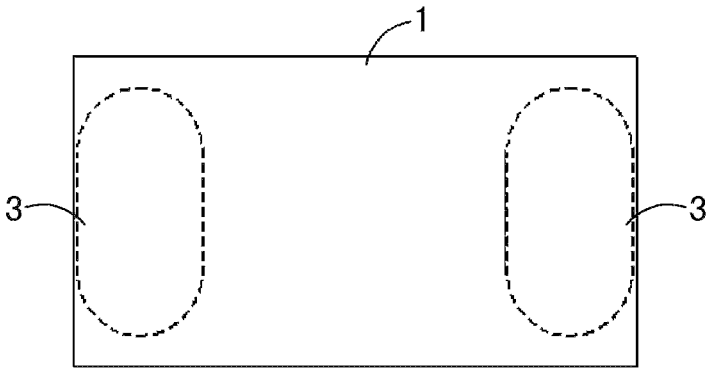
FIG. 12B is a top view of FIG. 12A.

Referring to FIGS. 12A and 12B, the difference between the third embodiment and the first embodiment of the electric reactor in the present disclosure only resides in that the shape of the cross section of the wrapping post 3 is an ellipse. A flat metallic wire may be used for the winding. For example, flat copper wires 10 may be wound around the wrapping posts 3 in a vertical winding manner, and there is a heat dissipation channel between two adjacent layers of flat copper wires 10. The flat metallic wire being wound in a vertical winding manner may facilitate heat dissipation.

In the third embodiment of the inductor, metallic foil may also be used for the winding.

Other structures of the third embodiment of the inductor are substantially the same as those of the first embodiment, and thus their detailed descriptions are omitted herein.

The Fourth Embodiment of the Inductor

Figure 13A:
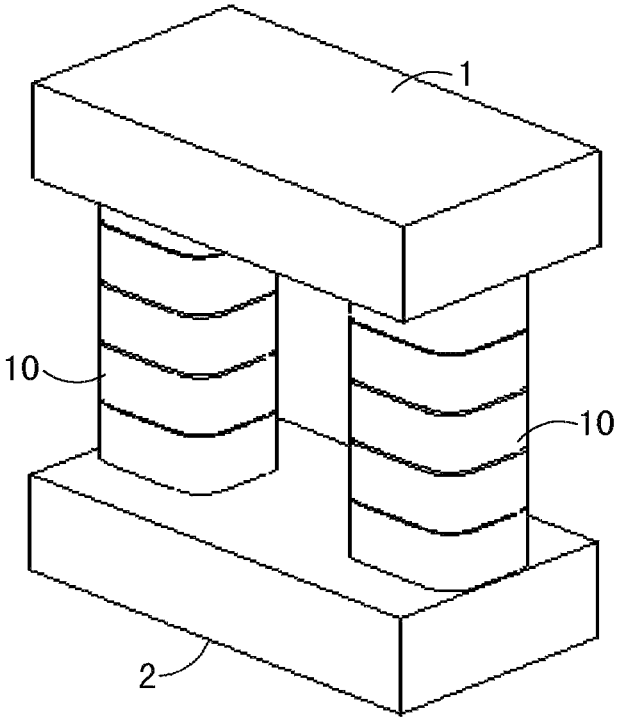
FIG. 13A is a schematic structural diagram of a fourth embodiment of an electric reactor according to the present disclosure.
Figure 13B:
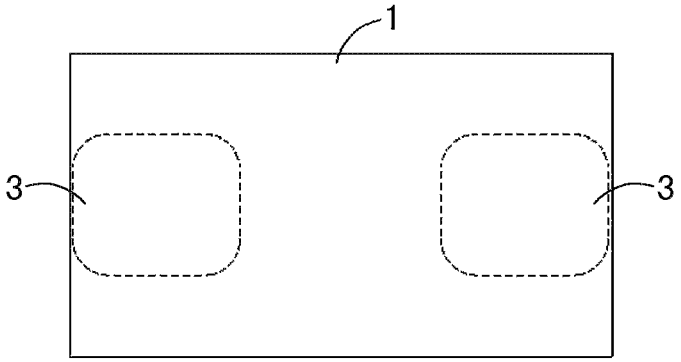
FIG. 13B is a top view of FIG. 13A.

Referring to FIGS. 13A and 13B, the difference between the fourth embodiment and the third embodiment of the electric reactor in the present disclosure only resides in that the shape of the cross section of the wrapping post 3 is a chamfered rectangle (e.g., a rectangle having circular arc chamfers).

Other structures of the fourth embodiment of the inductor are substantially the same as those of the third embodiment, and thus their detailed descriptions are omitted herein.

The Fifth Embodiment of the Inductor

Figure 14:
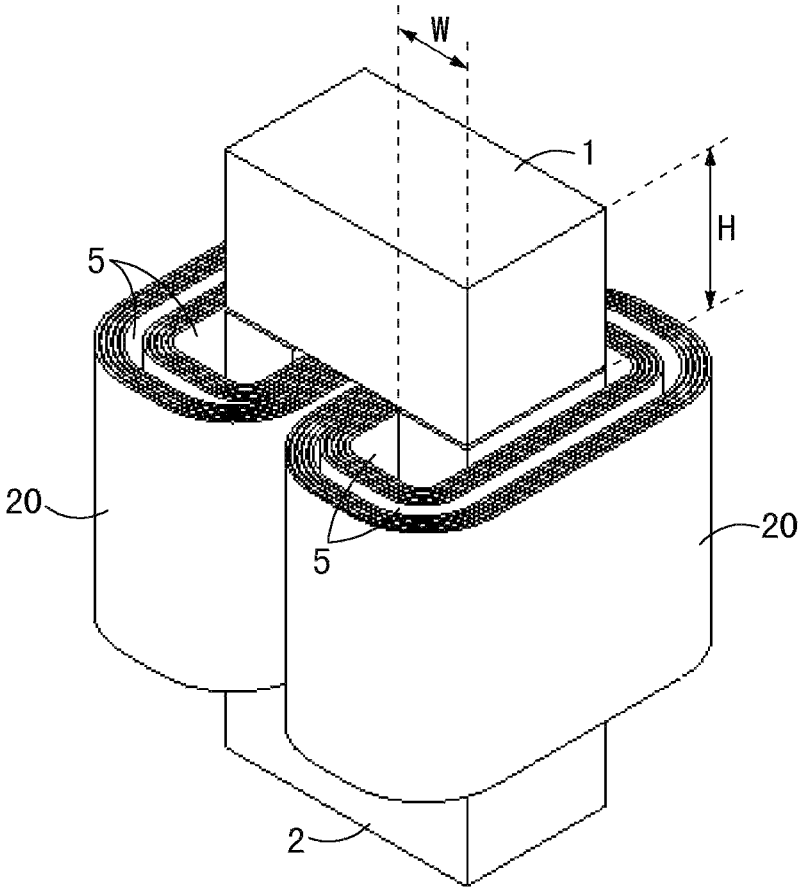
FIG. 14 is a schematic structural diagram of a fifth embodiment of an electric reactor according to the present disclosure.

Referring to FIG. 14, the fifth embodiment of the electric reactor of the present disclosure includes a magnetic core structure and a winding.

The magnetic core structure is similar to the second embodiment of the magnetic core structure of the present disclosure, in which the thickness of the upper cover plate 1, the thickness of the lower cover plate 2 and the thickness of the wrapping post 3 are equal to each other, the height H of the upper cover plate 1 is larger than the width W of the wrapping post 3, and the height of the lower cover plate 2 is larger than the width of the wrapping post 3. A front surface and a rear surface of the magnetic core structure are respectively in one plane.

The winding is formed by wound metallic foil 20. A heat dissipation channel 5 is disposed between the metallic foil 20 and the wrapping post 3, and a heat dissipation channel may also be disposed inside layers of the metallic foil 20.

In the fifth embodiment of the inductor, the winding may also be formed by flat metallic wire or other types of wound wires.

Other structures of the fifth embodiment of the inductor are substantially the same as those of the first embodiment, and thus their detailed descriptions are omitted herein.

The exemplary embodiments of the present disclosure are shown and described above in detail. It shall be understood that the present disclosure is not limited to the disclosed embodiments, and instead, the present disclosure intends to encompass various modifications and equivalent arrangements within the spirit and scope of the appended claims.

LIST OF REFERENCE SIGNS

1 upper cover plate
2 lower cover plate
3 wrapping post
4 air gap
5 heat dissipation channel
10 flat copper wire
20 metallic foil

What is claimed is:

1. An electric reactor, comprising:

a magnetic core structure and at least one winding, wherein the magnetic core structure comprising:

an upper cover plate and a lower cover plate which are arranged oppositely; and at least one wrapping post having two ends connected to the upper cover plate and the lower cover plate, respectively, wherein a cross-sectional area of the upper cover plate and/or a cross section area of the lower cover plate is larger than a cross-sectional area of the wrapping post, and the upper cover plate, the lower cover plate and the wrapping post are made of a magnetic powder core material, an amorphous material, a nanocrystalline material or a silicon steel material, wherein a thickness of the upper cover plate or a thickness of the lower cover plate is larger than a thickness of the wrapping post, and wherein a flat metallic wire is used for the winding in a vertical winding manner.

2. The electric reactor according to claim 1, wherein there is a heat dissipation channel between two adjacent layers of the flat metallic wires.

3. The electric reactor according to claim 1, wherein a direct current bias characteristic of the material of the upper cover plate and/or a direct current bias characteristic of the material of the lower cover plate is inferior to a direct current bias characteristic of the material of the wrapping post.

4. The electric reactor according to claim 1, wherein a loss characteristic of the material of the upper cover plate and/or a loss characteristic of the material of the lower cover plate is inferior to a loss characteristic of the material of the wrapping post.

5. The electric reactor according to claim 1, wherein a ratio of the cross-sectional area of the upper cover plate to the cross-sectional area of the wrapping post or a ratio of the cross-sectional area of the lower cover plate to the cross-sectional area of the wrapping post ranges from 1.1 to 3.

6. The electric reactor according to claim 1, wherein the wrapping post has a cross-sectional shape of a circle, an ellipse or a chamfered rectangle.

7. The electric reactor according to claim 1, wherein the number of the wrapping post is two, three or five.

8. The electric reactor according to claim 1, wherein a material of the upper cover plate or a material of the lower cover plate is FeSi magnetic powder core, FeSiAl magnetic powder core or Fe magnetic powder core, and a material of the wrapping post is FeSi magnetic powder core or FeNi magnetic powder core.

9. The electric reactor according to claim 1, wherein the upper cover plate and/or the lower cover plate has a shape of rectangular parallelepiped.

* * * * *